US005131769A

United States Patent [19]

Jones et al.

[11] Patent Number: 5,131,769

[45] Date of Patent: Jul. 21, 1992

[54] RIBBON CARTRIDGE

[75] Inventors: Bruce S. Jones, Franklin; Carl Massey, Nashville, both of Tenn.

[73] Assignee: Pelikan, Inc., Franklin, Tenn.

[21] Appl. No.: 722,906

[22] Filed: Jun. 28, 1991

[51] Int. Cl.[5] ..... B41J 32/00

[52] U.S. Cl. ..... 400/208; 400/54

[58] Field of Search ..... 400/207, 207 E, 227.2, 400/208, 703, 54, 194, 195, 196, 196.1

[56] References Cited

U.S. PATENT DOCUMENTS

| | | | |
|---|---|---|---|
| 4,900.171 | 2/1990 | Mueller et al. | 400/208 |
| 5,069,563 | 12/1991 | Daggs | 400/208 |

FOREIGN PATENT DOCUMENTS

| | | | |
|---|---|---|---|
| 222380 | 12/1984 | Japan | 400/207 |
| 71285 | 4/1985 | Japan | 400/207 |
| 54975 | 3/1986 | Japan | 400/207 |
| 78763 | 4/1988 | Japan | 400/207 |
| 120678 | 5/1988 | Japan | 400/207 |

*Primary Examiner*—Edgar S. Burr
*Assistant Examiner*—Ren Yan
*Attorney, Agent, or Firm*—John F. A. Earley; John F. A. Earley, III

[57] ABSTRACT

A ribbon cartridge comprises a housing having a bottom wall and a side wall extending upwardly therefrom to form an open top, a cover adapted to fit over the open top of the housing to close the housing to form a ribbon cartridge, an output arm and a take-up arm formed in the cartridge with a print space between the arms, the cartridge being adapted to hold a ribbon stuffed inside and extending between the arms from the output arm to the take-up arm, flexible fingers which are spaced apart from each other and attached at their base portions to the housing, with each finger being positioned in a finger opening in the bottom wall of the housing, whereby when an end tab of a finger meets resistance from a top wall of a correction cartridge, the finger is pushed into the interior of the housing, and when an end tab of a finger does not meet such resistance, it actuates the typewriter switch to actuate the typewriter. The method includes providing the ribbon cartridge, inserting it into a typewriter, inserting a correction tape cartridge into the typewriter, passing one of the fingers through a passage in the correction cartridge to contact the switch of the typewriter and actuate the typewriter, and blocking the other finger with the top surface of the correction tape cartridge and pushing the other finger back through its finger opening into the interior of the ribbon cartridge.

5 Claims, 2 Drawing Sheets

RIBBON CARTRIDGE

BACKGROUND OF THE INVENTION

1. Field of the Invention

This invention relates to ribbon cartridges for typewriters, and more particularly concerns ribbon cartridges which have actuating means for contacting a switch on the typewriter to actuate the typewriter so that the typewriter is not actuated unless a ribbon cartridge is in place in the typewriter.

2. Description of the Prior Art

Ribbon cartridges in the prior art have been provided with actuation tabs that are selective so as to contact a typewriter switch and activate the typewriter only if a certain type of correction tape cartridge is in place in the typewriter. The typewriter does not work in this prior art system if the correction tape cassette is not compatible with the ribbon cassette. This is a disadvantage if a compatible ribbon cartridge is not available. The typewriter operator must stop and get a compatible ribbon cartridge for the correction tape cartridge in the typewriter, or get a correction tape cartridge that is compatible with the new ribbon cartridge that she wishes to insert into the typewriter. If compatible cartridges are not available, the typewriter is shut down, unless the operator is willing to type without any correction tape cartridge in the typewriter, which is undesirable.

SUMMARY OF THE INVENTION

It is an object of this invention to overcome the disadvantages of the prior art and to provide a ribbon cartridge which is operable with any type of correction tape cartridge, including the lift-off type or the cover-up type.

It is another object to provide a ribbon cartridge with actuating fingers that are made integrally with the housing of the cartridge, as part of the housing, and are made in the same die as the housing and at the same time.

It is another object to provide a ribbon cartridge with actuating fingers that are not separate parts which must be attached to a ribbon cartridge by a separate assembly step, and which may be knocked-off and lost, making it impossible for the ribbon cartridge to actuate the typewriter.

It is another object to provide actuating fingers which are not as costly as separate parts to make and assemble.

DETAILED DESCRIPTION

Figure 1:
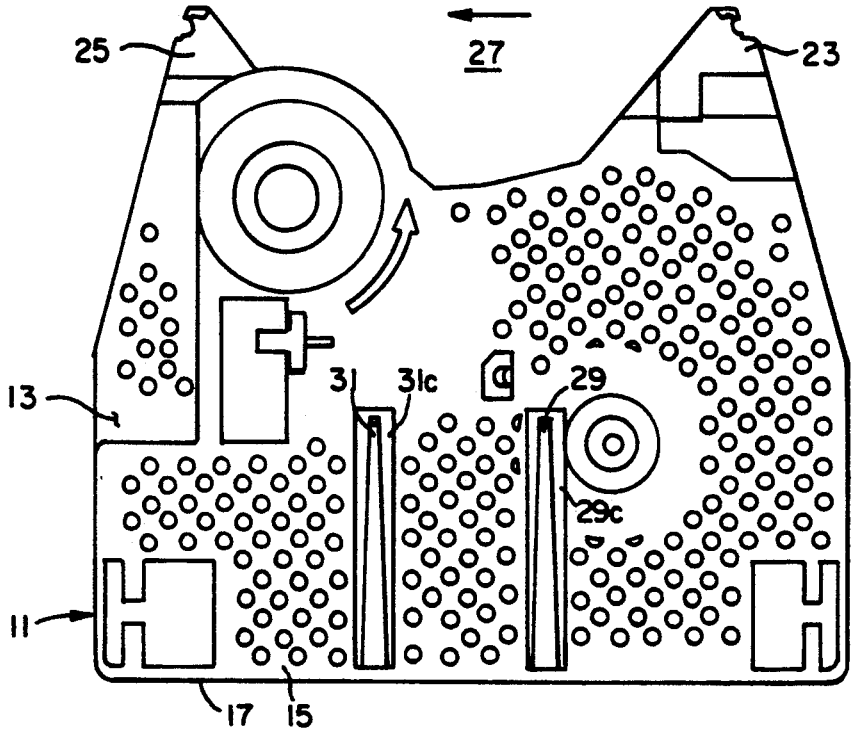
FIG. 1 is a view in bottom plan of a ribbon cartridge constructed in accordance with this invention.
Figure 2:
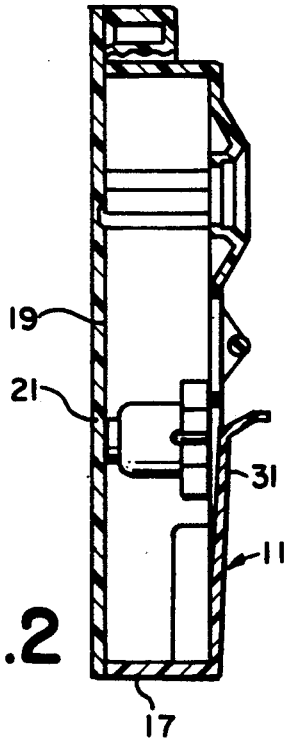
FIG. 2 is a view in side elevation of the ribbon cartridge of FIG. 1, looking from the left of FIG. 1.
Figure 3:
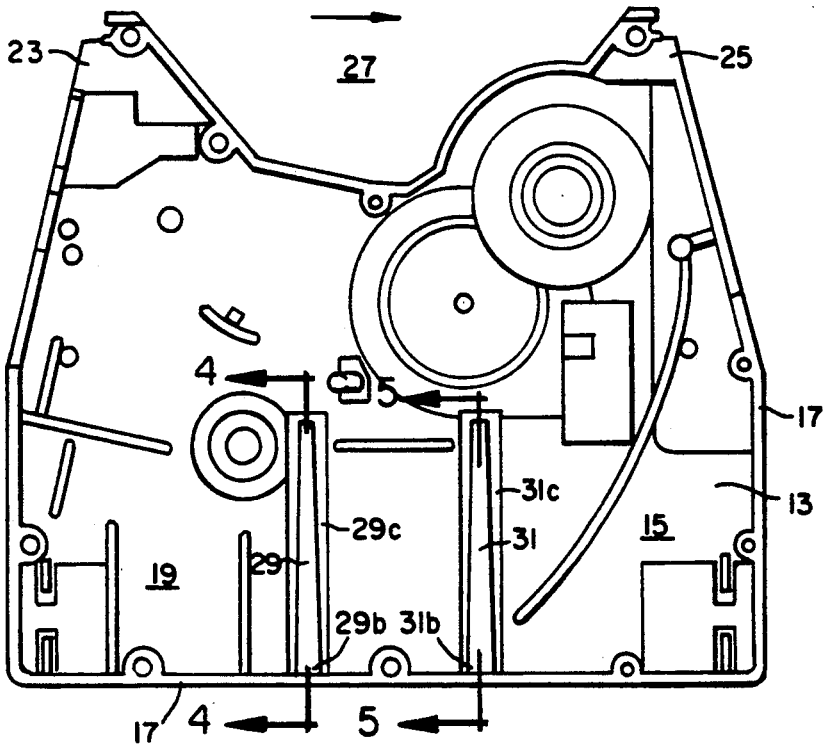
FIG. 3 is a view in top plan of the ribbon cartridge and shows the housing with its cover removed.

Turning now to the drawings, there is shown a ribbon cartridge or cassette 11 which comprises a housing 13 having a bottom wall 15 and a side wall 17 which extends upwardly from the bottom wall to form an open top 19.

A cover 21 is adapted to fit over the open top 19 of the housing 13 to close the housing and form the ribbon cartridge 11.

An output arm 23 and a take-up arm 25 are formed in the cartridge 11 with a print space 27 located between arms 23 and 25. The print space is where the typewriter types onto the ribbon and onto the paper. The cartridge 11 is adapted to hold a ribbon which is stuffed into the cartridge and which extends between the arms from the output arm 23 to the take-up arm 25.

Actuating means are provided on the bottom wall 15 of the cartridge 11 for contacting a switch on the typewriter to actuate the typewriter whether a lift-off correction cartridge, a cover-up correction cartridge, or no correction cartridge is being used with the ribbon cartridge 11.

The actuating means comprises a pair of flexible fingers 29, 31 having downwardly extending end tabs **29*a*, 31*a* which are adapted to contact the typewriter switch and actuate the typewriter. The flexible fingers 29, 31 are spaced apart from each other, and each finger 29, 31 is attached at its base portion 29*b*, 31*b* to the side wall 17 of the housing 13**.

Each finger 29, 31 is positioned in a finger opening **29*c*, 31*c* in the bottom wall 15 of the housing 13, whereby when the end tab 29*a*, 31*a*, meets resistance from the top wall of a correction cartridge, the finger 29, 31 is pushed into the interior of the housing 13. When the end tab 29*a*, 31*a***, does not meet such resistance, it passes through a passage in the correction cartridge and actuates the typewriter switch to actuate the typewriter.

Figure 4:
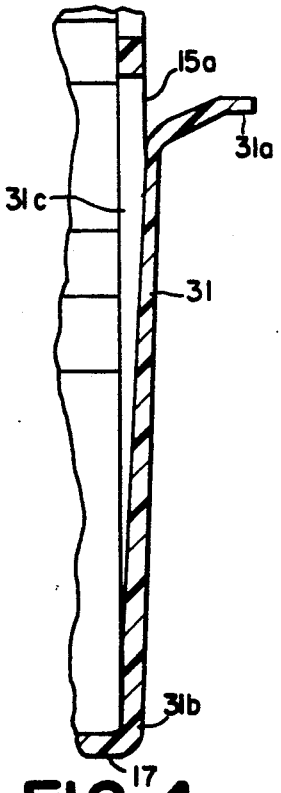
FIG. 4 is a view in section of an actuating finger of the invention taken as indicated by the lines and arrows 4—4 which appear in FIG. 3.
Figure 5:
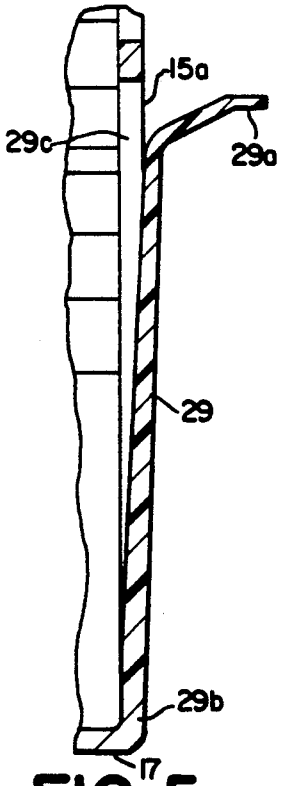
FIG. 5 is a view in section of another actuating finger taken as indicated by the lines and arrows 5—5 which appear in FIG. 3.
Figure 6:
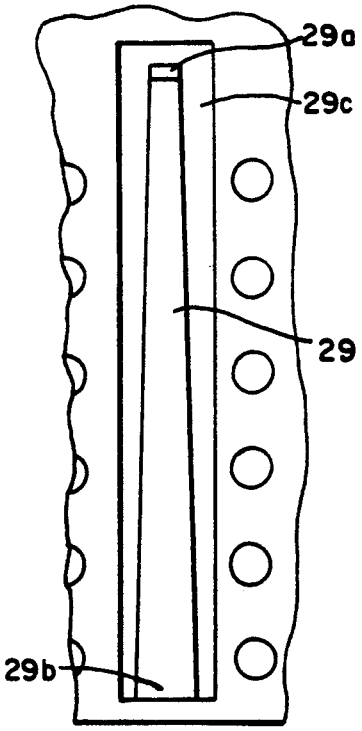
FIG. 6 is a partial view in bottom plan of the actuating finger of FIG. 5 looking from the right of FIG. 5.

As is shown in FIGS. 4 and 5, the bottom wall 15 of the housing 13 lies in a plane **15*a*, and the fingers 29, 31 and their end tabs 29*a*, 31*a* extend below the plane 15*a* of bottom wall 15**.

In operation, the method of actuating a typewriter comprises the steps of providing a ribbon cartridge 11 which comprises a housing 13 having a bottom wall 15 and a side wall 17 extending upwardly therefrom to form an open top 19, a cover 21 adapted to fit over the open top 19 of the housing to close the housing 13 and form the ribbon cartridge 11, an output arm 23 and a take-up arm 25 formed in the cartridge 11 with a print space 27 between the arms 23, 25, the cartridge 11 being adapted to hold a ribbon stuffed in the cartridge 11 and extending between the arms 23, 25 from the output arm 23 to the take-up arm 25, and actuating means on the bottom wall 15 of the cartridge 11 for contacting a switch on the typewriter to actuate the typewriter whether a lift-off correction cartridge, a cover-up correction cartridge, or no correction cartridge is being used with the ribbon cartridge 11. The actuating means comprises a pair of flexible fingers 29, 31 having downwardly extending end tabs **29*a*, 31*a*. The flexible fingers 29, 31 are spaced apart from each other. Each finger 29, 31 is attached at its base portion 29*b*, 31*b* to the side wall 17 of the housing 13, and each finger 29, 31 is positioned in a finger opening 29*c*, 31*c* in the bottom wall 15 of the housing 13, whereby when the end tab 29*a*, 31*a* meets resistance from the top wall of a correction cartridge, the finger 29, 31 is pushed into the interior of the housing 13, and when the finger 29, 31** does not meet such resistance it passes through a passageway in the correction cartridge and actuates the typewriter switch to actuate the typewriter.

The method includes the steps of inserting the ribbon cartridge 11 into a typewriter, and inserting a correction tape cassette into the typewriter. The correction tape cassette has a top surface with a passage therein that extends to an actuation switch of the typewriter.

The method further includes passing one of the fingers 29, 31 through the passage in the correction cartridge to contact the switch and actuate the typewriter, blocking the other finger with the top surface of the correction tape cartridge, and pushing the other finger through its finger opening into the interior of the ribbon cartridge.

In the method of this invention, the switch of the typewriter is contacted by at least one of the flexible fingers 29, 31, whether the typewriter has inserted therein a lift-off correction cartridge, or a cover-up correction cartridge, or no correction cartridge.

If a correction cartridge is in place in the typewriter, which is the usual case, its top surface obstructs the path of one of the flexible fingers 29, 31 and pushes it back into the interior of the housing 13 through its finger opening 29*c*, 31*c*.

We claim:

1. A ribbon cartridge comprising a housing having a bottom wall having finger openings and a side wall extending upwardly therefrom to form an open top, a cover adapted to fit over the open top of the housing to close the housing and form a ribbon cartridge, an output arm and a take-up arm formed in the cartridge with a print space between the arms, said cartridge being adapted to hold a ribbon stuffed in the cartridge and extending between the arms from the output arm to the take-up arm, and actuating means on the bottom wall of the cartridge for contacting a switch on a typewriter to actuate the typewriter whether a lift-off correction cartridge, a cover-up correction cartridge, or no correction cartridge is being used with the ribbon cartridge, said actuating means comprising a pair of flexible fingers having downwardly extending end tabs, said flexible fingers being spaced apart from each other, each finger being attached at its base portion to the housing, each finger being positioned in said finger opening in the bottom wall of the housing, whereby when the end tab of a finger meets resistance from the top wall of a correction cartridge the finger is pushed into the interior of the housing, and when the end tab of a finger does not meet such resistance it actuates a switch to actuate the typewriter.

2. The ribbon cartridge of claim 1, said bottom wall lying in a plane, said fingers and end tabs extending below the plane of the bottom wall.

3. A method of actuating a typewriter having a switch which must be turned on to activate the typewriter and place it in condition for use, comprising providing a ribbon cartridge including a housing having a bottom wall having finger openings and a side wall extending upwardly therefrom to form an open top, a cover adapted to fit over the open top of the housing to close the housing and form a ribbon cartridge, an output arm and a take-up arm formed in the cartridge with a print space between the arms, said cartridge being adapted to hold a ribbon stuffed in the cartridge and extending between the arms from the output arm to the take-up arm, and actuating means on the bottom wall of the cartridge for contacting the switch on a typewriter to actuate the typewriter whether a lift-off correction cartridge, a cover-up correction cartridge, or no correction cartridge is being used with the ribbon cartridge, said actuating means comprising a pair of flexible fingers having downwardly extending end tabs, said flexible fingers being spaced apart from each other, each finger being attached at its base portion to the bottom wall of the housing, each finger being positioned in said finger opening in the bottom wall of the housing, whereby when the end tab meets resistance from the top wall of a correction cartridge the finger is pushed into the interior of the housing, and when an end tab does not meet such resistance it actuates the switch to actuate said typewriter, inserting the ribbon cartridge into the typewriter, and contacting the switch of the typewriter with at least one of said flexible fingers.

4. A method of actuating a typewriter having a switch which must be turned on to activate the typewriter and place it in condition for use, comprising providing a ribbon cartridge including a housing having a bottom wall having finger openings and a side wall extending upwardly therefrom to form an open top, a cover adapted to fit over the open top of the housing to close the housing and form a ribbon cartridge, an output arm and a take-up arm formed in the cartridge with a print space between the arms, said cartridge being adapted to hold a ribbon stuffed in the cartridge and extending between the arms from the output arm to the take-up arms, and actuating means on the bottom wall of the cartridge for contacting the switch on a typewriter to actuate the typewriter whether a lift-off correction cartridge, a cover-up correction cartridge, or no correction cartridge is being used with the ribbon cartridge, said actuating means comprising a pair of flexible fingers having downwardly extending end tabs, said flexible fingers being spaced apart from each other, each finger being attached at its base portion to the housing, each finger being positioned in said finger opening in the bottom wall of the housing, whereby when the end tab meets resistance from the top wall of a correction cartridge the finger is pushed into the interior of the housing, and when an end tab does not meet such a resistance it actuates the switch to actuate said typewriter, inserting a correction tape cassette into the typewriter, said correction tape cassette having a top surface with a passage therein that extends to the switch of the typewriter, inserting the ribbon cassette in the ribbon cartridge into the typewriter, passing one of the fingers through said passage to contact the switch and actuate the typewriter, blocking the other finger with the top surface of the correction tape cartridge, and pushing the other finger back through its finger opening into the interior of the ribbon cartridge.

5. A method of actuating a typewriter having a switch which must be turned on to activate the typewriter and place it in condition for use, comprising providing a ribbon cartridge including a housing having a bottom wall having finger openings and a side wall extending upwardly therefrom to form an open top, a cover adapted to fit over the open top of the housing to close the housing and form a ribbon cartridge, an output arm and a take-up arm formed in the cartridge with a print space between the arms, said cartridge being adapted to hold a ribbon stuffed in the cartridge and extending between the arms from the output arm to the take-up arm, and actuating means on the bottom wall of the cartridge for contacting the switch on a typewriter to actuate the typewriter whether a lift-off correction cartridge, a cover-up correction cartridge, or no correction cartridge is being used with the ribbon cartridge, said actuating means comprising a pair of flexible fingers having downwardly extending end tabs, said flexible fingers being spaced apart from each other, each finger being attached at its base portion to the housing, each finger being positioned in said finger opening in the bottom wall of the housing, whereby when the end tab meets resistance from the top wall of a correction cartridge the finger is pushed into the interior of the housing, and when an end tab does not met such resistance it actuates the switch to actuate said typewriter, inserting the ribbon cartridge into the typewriter, contacting the switch of the typewriter with one of said flexible fingers, obstructing the path of the other flexible finger, and pushing the other flexible finger into the housing through its finger opening in the cartridge housing bottom wall.

* * * * *